United States Patent [19]

Grözinger et al.

[11] 4,408,118

[45] Oct. 4, 1983

[54] CONTROL NETWORK FOR USE IN KNITTING MACHINES AND THE LIKE

[75] Inventors: Gerhard Grözinger, Spaichingen; Hartmut Schindler, Albstadt; Franz Schmid, Bodelshausen, all of Fed. Rep. of Germany

[73] Assignee: Sipra Patententwicklungs- und Beteiligungsgesellschaft mbH, both of Stuttgart, Fed. Rep. of Germany

[21] Appl. No.: 166,253

[22] Filed: Jul. 7, 1980

[30] Foreign Application Priority Data

Jul. 12, 1979 [DE] Fed. Rep. of Germany ..... 2928076

[51] Int. Cl.[3] ..... D04B 15/68; H03K 5/13; H03K 21/36

[52] U.S. Cl. ..... 377/2; 377/17; 328/155; 66/218

[58] Field of Search ..... 328/55, 155; 235/92 PS, 235/92 PE, 92 CT, 92 DM

[56] References Cited

U.S. PATENT DOCUMENTS

| | | | |
|---|---|---|---|
| 3,470,714 | 10/1969 | Corbaz | 66/219 X |
| 3,728,635 | 4/1973 | Eisenberg | 328/55 |
| 3,745,791 | 7/1973 | Cuche | 66/219 |
| 3,972,208 | 8/1976 | Ferrington | 66/219 |
| 4,084,082 | 4/1978 | Alfke | 235/92 PE X |
| 4,095,186 | 6/1978 | Vesel | 328/55 |
| 4,180,778 | 12/1979 | Worthington | 328/155 |
| 4,215,314 | 7/1980 | Addor | 328/55 |
| 4,251,722 | 2/1981 | Vautier | 235/92 DM |
| 4,290,022 | 9/1981 | Puckette | 328/55 |

FOREIGN PATENT DOCUMENTS

| | | |
|---|---|---|
| 1463031 | 5/1969 | Fed. Rep. of Germany . |
| 2055100 | 3/1971 | Fed. Rep. of Germany . |

*Primary Examiner*—Felix D. Gruber
*Attorney, Agent, or Firm*—Michael J. Striker

[57] ABSTRACT

Input pulses generated by rotation of a knitting machine are used to produce output pulses that energize needle selection mechanisms therein. A control system operates in such a fashion as to advance the output pulses with respect to the input pulses, while keeping pulse frequency constant. The control system is clocked, and a forward counter is programmed with a number which is dependent upon knitting machine speed, and which number is derived from the number of clock pulses intervening between subsequent input pulses. After the forward counter has been so programmed, it is clocked by the clock until the appropriate number of clock pulses has been counted. At that time, a pulse is generated by reverse counter and a monostable multivibrator, which is used to produce an output pulse according to a program stored in a PROM. Provision is made to bypass the counter when the knitting machine is operated at low speeds.

8 Claims, 4 Drawing Figures

CONTROL NETWORK FOR USE IN KNITTING MACHINES AND THE LIKE

BACKGROUND OF THE INVENTION

1. FIELD OF THE INVENTION

This invention pertains to a control system which can advance an outgoing train of output pulses with respect to an incoming train of input pulses in accordance with a predetermined relationship while keeping both trains at a common frequency. The invention herein finds particular application in control systems used in electrically operated knitting machines and the like.

2. DESCRIPTION OF THE PRIOR ART

In knitting machines, the mechanisms which select the knitting needles utilized are electrically operated, and require response times which are known in advance. Moreover, such machines can be operated over a range of speeds.

When a knitting machine is operated at a slow speed, it is sufficient to operate the needle selecting mechanisms in synchronism with each revolution or part of a revolution of the machine, since at slow speeds the response times of the mechanisms in question is not detrimental to proper operation. However, as the speed of the knitting machine is increased, it becomes necessary to energize such mechanisms in advance, in order to have needle selection take place at the desired point in the machine's operating cycle. As the machine is speeded up, this advancement must be progressively increased in order to produce an accurately knitted product.

Thus, it has already been proposed to utilize control systems which advance needle selection in accordance with machine operating speed. For example, Federal Republic of Germany Auslegeschrift No. 14 63 031 and Federal Republic of Germany Auslegeschrift No. 20 55 100 pertain to control systems which will operate in this fashion. In the first of these two references, a control system is disclosed in which the entire speed range of the machine is divided into three stages. In that stage which encompasses the lowest operating speeds of the machine, no needle selection advance takes place. In the next stage of machine speeds, selection advance is increased but is constant within the stage in question. In the highest stage of machine speeds, selection advance is once again increased, and held at a constant value. Thus, in this reference needle selection advance is increased in discrete steps which are comparatively large. In the second reference, needle selection advance increases continuously as machine speed increases.

In both of these prior-art control systems, an analog selection advance is used. With analog control systems, there is no exact correlation between needle selection and machine speed, so that errors in needle selection arise which increase in magnitude with time. Moreover, with such analog control systems, long-term operation and temperature variation can adversely affect machine accuracy and therefore degrade the fabric produced.

Therefore, it would be advantageous to provide a control system for knitting machines and the like which would operate in a digital fashion in order to ensure that needle selection advance would take place in an exactly calibrated fashion, and in order to ensure uniformity in operation over long periods of time.

SUMMARY OF THE INVENTION

This object, along with others which will appear hereinafter, is achieved by utilizing a completely digital control system of this type. In the system disclosed herein, a pulse generator is connected to the machine, and generates pulses at a rate corresponding to the rotary speed of the machine. Thus, these pulses are exactly determined by the angular position of the rotating part of the machine at any given time. Moreover, a clock, which may advantageously be manufactured using a quartz oscillator circuit, is used to provide an independent source of clock pulses which do not vary in any way with machine rotation.

In this invention, clock pulses are used to perform two separate functions. Firstly, clock pulses generated intermediate to adjacent input pulses issued by the machine provide an exact measurement of machine speed at any given time. Secondly, clock pulses so generated can be used to drive a counter that issues a pulse generating signal after a predetermined number of such clock pulses have been counted. This number will depend upon machine speed—it will decrease as machine speed increases.

As will be explained in more detail hereinafter, the number of clock pulses which are generated in between two successive input pulses are counted in a forward counter and after counting are used either to pass the pulse generated by the pulse generator directly to the output of the control system or to address a programmable memory which stores at its storing locations binary numbers smaller than the corresponding addresses, thus producing via a reverse counter another train of output pulses which are generated in advance of the momentary cycle of the pulse generator about a time interval which is predetermined by the program at the particular address. Thus, the period of time by which the output pulses are advanced with respect to the input pulses is determined by the number programmed into the forward counter, which in turn is determined by the frequency of input pulses introduced into the control system by the machine.

In the preferred embodiment of the invention, provision is made for a counter bypass which causes output pulses to be generated independently of counter operation. This counter bypass finds application when the knitting machine is to be operated at slow speeds. As will be seen hereinafter, it is unnecessary to program the counter and cause other circuitry to come into play when it is already known in advance that machine speed is sufficiently low that needle selection advance is not an important factor.

The novel teachings which are considered as characteristic for the invention are set forth in particular in the appended claims. The invention itself, however, both as to its construction and its method of operation, together with additional objects and advantages therefor, will be best understood from the following description of specific embodiments when read in connection with the accompanying drawings.

DETAILED DESCRIPTION OF PREFERRED EMBODIMENTS

Figure 2:
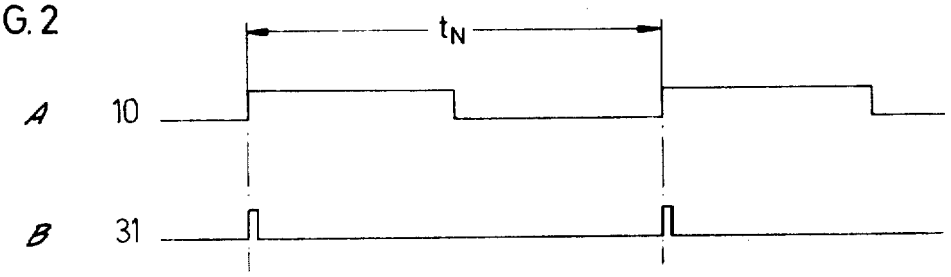
FIG. 2 shows two graphs of an incoming train of input pulses and an outgoing train of output pulses generated by the invention when a knitting machine is operated at slow speed.

Referring first to FIG. 2, it can be seen that FIG. 2 (A) shows an incoming train of input pulses 10. In FIG. 2 (A), $t_N$ shows the period of a single input pulse—a pulse which is generated by a pulse generator that operates in fixed dependence upon knitting machine rotation. In FIG. 2 (B), an outgoing train of output pulses 31 is shown, which outgoing train of output pulses is utilized to drive needle selection elements within the machine. At low speeds, each time a positive flank of an input pulse is encountered, an output pulse is generated and the output pulses are not advanced with respect to the input pulses.

Figure 3:
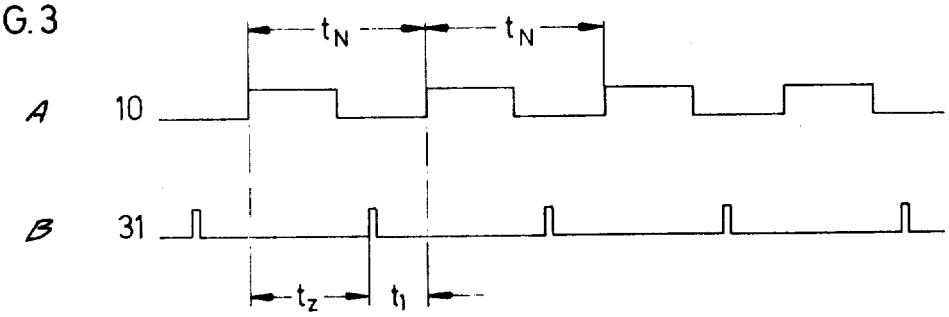
FIG. 3 shows two graphs showing the advance of the outgoing train of output pulses with respect to the incoming train of input pulses generated by the invention when a knitting machine is run at a higher speed.

However, when reference is had to FIG. 3 (A) and (B), it can be seen that as machine speed is increased, it is necessary to advance the outgoing train of output pulses with respect to the incoming train of input pulses in order to properly advance needle selection. In FIG. 3, $t_N$ remains the period of pulses generated as a result of machine rotation, but is smaller because the pulses are generated faster at higher machine speeds. FIG. 3 (B) shows that it is necessary to advance the outgoing train of output pulses by a period of time $t_l$ with respect to the incoming train of input pulses.

Figure 1:
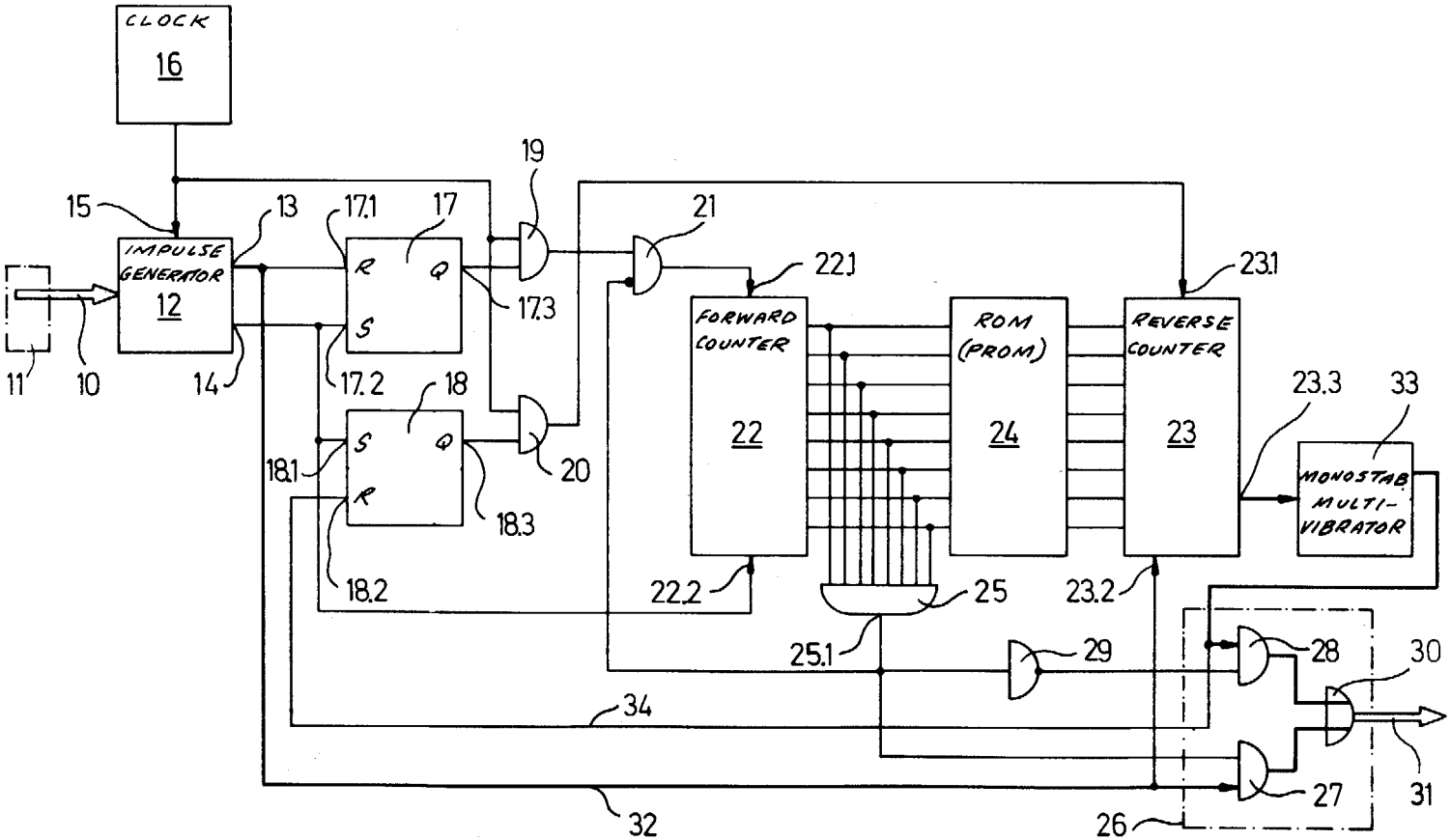
FIG. 1 shows a schematic diagram of the invention in block-diagram form.

In order to produce input pulses 10 and output pulses 31 which are properly phased with respect to each other according to a predetermined program and in dependence on the rotary speed of the machine, the circuit shown in FIG. 1 is utilized. Incoming pulses 10 are generated by pulse generator 11, which is attached to a knitting machine (not shown) and which generates input pulses 10 periodically each time the knitting machine rotates by a predetermined angle. Input pulses 10 are routed to impulse generator 12, which is clocked by clock 16 at clock input 15. Clock 16 is advantageously manufactured using a quartz oscillator circuit operating at a frequency of 100 kHz.

Each time an input pulse 10 arrives at impulse generator 12, two pulses are generated at outputs 13 and 14 thereof. The first of these pulses appears at output 13, while the second appears at output 14. These two pulses are only slightly displaced in time with respect to each other, and are spaced by the period between adjacent clock pulses. (As will be seen hereinafter, it is of great importance that clock 16 operate at a much greater frequency than the frequency of input pulses 10.)

Output 13 of impulse generator 12 is connected to reset input 17.1 of flipflop 17. Output 14 of impulse generator 12 is connected to set inputs 17.2 and 18.2 of flipflops 17 and 18 respectively. Therefore, when a pulse appears at output 13, flipflop 17 is reset so that its output 17.3 is brought logically low. When a pulse appears at output 14, both flipflops 17 and 18 are set so that their outputs 17.3 and 18.3 respectively are brought logically high.

Outputs 17.3 and 18.3 are connected to inputs of AND-gates 19 and 20 respectively. Moreover, clock 16 is connected to another input of AND-gates 19 and 20. Thus, when flipflop 17 is set, the output of AND-gate 19 will be pulsed with clock pulses from clock 16, while when flipflop 18 is set, the output of AND-gate 20 will be pulsed with clock pulses. In the event that flipflop 17 is reset, the output of AND-gate 19 will remain logically low, with the same relationship holding true between flipflop 18 and AND-gate 20.

Reverse counter 23 is a programmable counter with a clocked input 23.1, a set input 23.2, and an output 23.3. When pulse appears at set input 23.2, counter 23 counts in reverse from a number programmed into it each time that a pulse appears at clocked input 23.1. When reverse counter 23 has counted backwards from the number which has been programmed into it to zero, a pulse appears at output 23.3 and thus monostable multivibrator 33 is triggered.

Reverse counter 23 is programmed by read-only memory 24, which can be constructed either as a straight read-only memory or as a programmable read-only memory. Read-only memory 24, in response to address inputs from forward counter 22 discussed immediately below, programs reverse counter 23 with a number that is predetermined according to the needle selection advance curve which the control system is designed to implement. Thus, when read-only memory 24 is addressed by forward counter 22, reverse counter 23 is appropriately programmed with a number, from which number reverse counter 23 can be counted backwards as clock pulses appear at clock input 23.1.

Initially, upon receipt of an input pulse 10, impulse generator 12 generates a pulse at output 13, resetting flipflop 17 so as to bring output 17.3 logically low. Simultaneously, this pulse appears at set input 23.2 of reverse counter 23 to cause whatever number stored in read-only memory 24 at the address currently addressed by forward counter 22 to be programmed into reverse counter 23.

After reverse counter 23 has thus been programmed, a pulse is generated at output 14 of impulse generator 12. This pulse sets flipflops 17 and 18. Thus, the outputs of AND-gates 19 and 20 pulse in synchronism with clock 16. Each time that the output of AND-gate 20 pulses, reverse counter 23 counts backwards one count while forward counter 22 counts forward one count. (It will be noted that the output of AND-gate 19 is connected to clocked input 22.1 of forward counter 22 via AND-gate 21. That input of AND-gate 21 which is not connected to AND-gate 19 is connected to AND-gate 25, and is an inverting input. For purposes of the present discussion, it will be assumed that output 25.1 of AND-gate 25 is logically low, so that forward counter 22 is indeed counted forward one count each time a clock pulse appears at clocked input 22.1.)

As clock pulses from clock 16 continue to be generated, reverse counter 23 and forward counter 22 will each be counted by one count—backward, in the case of reverse counter 23, and forward, in the case of forward counter 22. At some point, when the knitting machine is operating at a relatively high speed, reverse counter 23 will count down to zero. At this time, a pulse will appear at output 23.3, triggering monostable multivibrator 33.

Inasmuch as it has been assumed that output 25.1 of AND-gate 25 is logically low, and inasmuch as output 25.1 is connected to inverter 29, it can be seen that AND-gate 28 will have a logically high output while monostable multivibrator 33 is in its unstable state. Thus, a pulse will appear at the output of AND-gate 28, and will thus appear at the output of OR-gate 30, since an input of OR-gate 30 is connected to the output of AND-gate 28. Thus, an output pulse 31 is generated.

As monostable multivibrator 33 causes an output pulse 31 to be produced, it also pulses reset input 18.2 of flipflop 18. This resets flipflop 18, bringing output 18.3 logically low, and severing the connection between output 18.3 and clocked input 23.1 of reverse counter 23. Thus, reverse counter 23 continues to receive no more pulses, and does not count backwards any further than zero.

However, although flipflop 18 is reset, flipflop 17 remains in its set state and clock pulses continue to be routed to clocked input 22.1 of forward counter 22. Each time a clock pulse appears at clocked input 22.1, forward counter 22 counts forward one count and changes the configuration of signals appearing at its parallel data outputs, which are connected to address inputs of read-only memory 24.

Assuming for the moment that all of the parallel data outputs of forward counter 22 are not brought logically high, a subsequent input pulse 10 routed to impulse generator 12 will cause a pulse to appear at output 13. Thus, flipflop 17 will be reset, the transmission of clock pulses from clock 16 to clock input 22.1 of forward counter 22 will cease, and the status of the parallel data outputs of forward counter 22 will remain at the highest count counted by forward counter 22. In order to understand how a conventional non-low speed cycle of operation of the invention takes place, it is only necessary to note that reset input 22.2 of forward counter 22 is connected to output 14 of impulse generator 12. When a pulse appears at output 14, forward counter 22 is reset to zero and begins counting forwardly from that point. Thus, it can be seen that the invention (during a non-low speed mode) operates in the following fashion:

By the time that a pulse appears at output 13, forward counter 22 has counted up so that its parallel data outputs represent a binary data word. This data word is used to address read-only memory 24 and to cause a number stored therein at that address location to be programmed into reverse counter 23 upon the receipt of the pulse at set input 23.2. Thus, when a pulse appears at output 13, forward counter 22 is set to zero and reverse counter 23 is set to start counting from some number stored in read-only memory 24.

Upon generation of a pulse at output 14, a clock pulse is routed to clocked input 23.1 of reverse counter 23, causing reverse counter 23 to count backwards one count. Simultaneously, flipflop 17 is set and forward counter 22 counts forward one count, i.e., to one, since forward counter 22 had previously been reset to zero.

After generation of a pulse at output 14, an interval of time normally passes during which no further pulses are generated at either output 13 or output 14. During this interval of time, clock pulses from clock 16 are clocked into forward counter 22 and reverse counter 23, causing forward counter 22 to count up while reverse counter 23 counts down. Subsequently, reverse counter 23 reaches zero, at which point an output pulse 31 is generated while reverse counter 23 is disabled from subsequent clocking by clock 16. However, after such generation of output pulse 31 and cutoff of reverse counter 23, forward counter 22 continues to count forwardly, changing the states of its parallel data outputs accordingly.

Finally, a subsequent input pulse 10 causes a pulse to appear at output 13, causing reverse counter 23 to be appropriately programmed by read-only memory 24, which is addressed by the highest count registered by forward counter 22.

Thus, it can be seen that the period of time by which an output pulse 31 is advanced with respect to a subsequent input pulse 10 is determined by the number programmed into reverse counter 23 by read-only memory 24. By suitable programming of read-only memory 24, an advance curve which is desired can be completely predetermined according to whatever mathematical relationship the knitting machine designer believes to be appropriate. It is not necessary that each address in read-only memory store a different number which can be programmed into reverse counter 23—adjacent addresses may have identical numbers stored thereat if incremental changes in knitting machine speed are unimportant in needle selection advance.

As shown in FIG. 1, forward counter 22 and reverse counter 23 are both 8-bit counters—they count from 0 up to 255. However, counters of lesser or greater bit capacity may be used according to the application desired.

When a knitting machine is operated at a very low speed, such as less than perhaps 8 revolutions per minute, needle selection advance becomes unnecessary since the machine is operating slowly enough that response time of the needle selection mechanisms need not be taken into account. Thus, a bypass for reverse counter 23 is provided.

This counter bypass is constituted by AND-gate 25, which in this instance has 8 inputs, each input being connected to a corresponding one of the parallel data outputs of forward counter 22. Output 25.1 of AND-gate 25 is connected both to the inverted input of AND-gate 21 and to an input of AND-gate 27. Another input of AND-gate 27 is connected to output 13 of impulse generator 12, while AND-gate 27 is itself connected at its output to an input of OR-gate 30.

If the knitting machine is operating very slowly, forward counter 22 counts forward extremely rapidly (at the frequency of clock 16) until it counts all the way up to 255. At this point, output 25.1 goes logically high, causing the output of AND-gate 21 to go logically low and therefore preventing further clocking of forward counter 22 at clocked input 22.1. Furthermore, both inputs of AND-gate 27 are brought logically high simultaneously, since for all practical purposes the switch-on of AND-gate 25 is practically instantaneous with the generation of a pulse at output 13.

Thus, in this low-speed case, an output pulse 31 is generated not by reverse counter 23 in cooperation with multivibrator 33 and AND-gate 28, but rather directly via forward counter 22 and AND-gate 25, in cooperation with AND-gate 27. Thus, with input pulses 10 of sufficiently low frequency, the operation of read-only memory 24, reverse counter 23, and ancillary components becomes irrelevant—output pulses 31 bear no relation to whatever happens with monostable multivibrator 33, since when output 25.1 of AND-gate 25 is brought logically high, the output of AND-gate 28 will remain logically low since one of its inputs is logically low.

Figure 4:
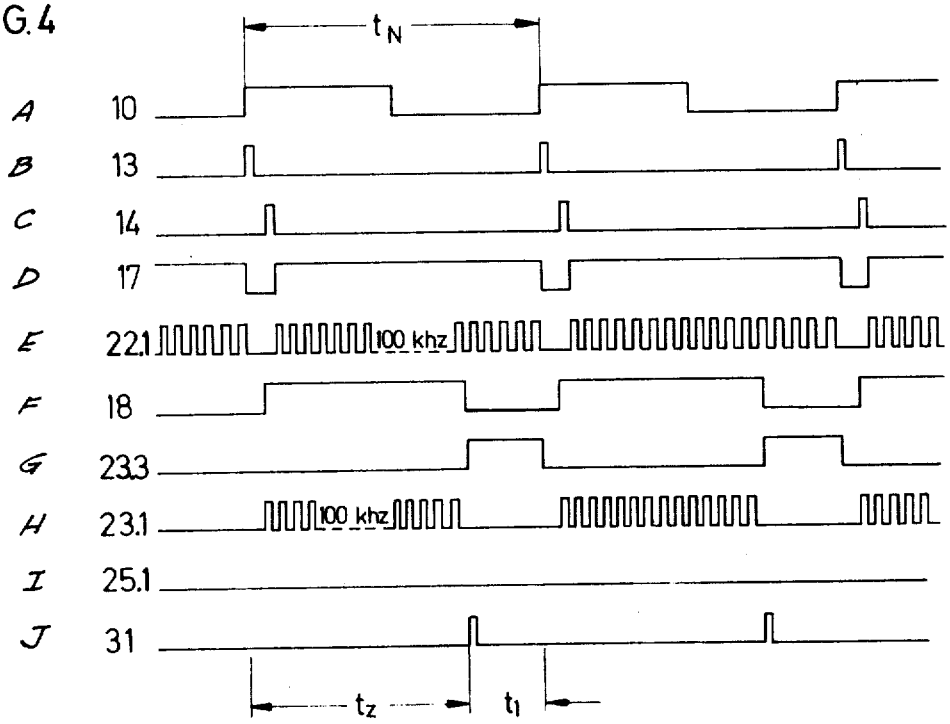
FIG. 4 shows ten graphs showing signals which exist within the control system as a function of time.

The operation of various components of the invention are shown in FIG. 4, in which it is assumed that the knitting machine operates at sufficiently high speeds that output 25.1 of AND-gate 25 is never brought logically high. Initially, an input pulse 10 is routed to impulse generator 12. On the rising flank of this input pulse, a pulse is generated at output 13, and a like pulse is generated at output 14 one clock pulse later. Thus, flipflop 17 is quickly reset and set again, causing clocking of forward counter 22 at clock input 22.1 to be interrupted for that time during which flipflop 17 is reset. Upon generation of a pulse at output 14, reverse counter 23 is clocked at clock input 23.1, while flipflop 18 is in its set state.

Some period of time later, reverse counter 23 counts down to zero, causing a pulse signal at output 23.3 to be generated and therefore causing a short pulse to appear at the output of monostable multivibrator 33. This, in turn, causes an output pulse 31 to be generated.

Although clocking of reverse counter 23 has been cut off, clocking of forward counter 22 continues until such time as another input pulse 10 appears at the input to impulse generator 12. Once again, the cycle is repeated. The time $t_1$ between the rising flank of output pulse 31 and the rising flank of the subsequent input pulse 10 is the period of time by which the outgoing train of output pulses 31 is advanced with respect to the incoming train of input pulses 10.

It will be noted that it is always assured that at non-low speeds, reversing counter 23 will always count down to zero prior in time to the receipt of a subsequent input pulse 10 by impulse generator 12. The reason why this will always be the case is because read-only memory is suitably programmed to accomplish exactly this result—it is precisely the intent of this invention to provide a needle selection advance at non-low knitting machine speeds, so that an output pulse 31 is generated by such countdown prior to receipt of a subsequent input pulse 10 by impulse generator 12.

Finally, it will be noted that the demarcation between "low-speed" and "non-low speed" is determined by the number of bits in forward counter 22. The fewer the number of bits in forward counter 22, the sooner will output 25.1 of AND-gate 25 go logically high. Thus, the sooner that this takes place, the lower will be the boundary between "low speed" and "non-low speed". As the number of bits in forward counter 22 is increased, more clock pulses will be required to bring output 25.1 of AND-gate 25 logically high, raising the "non-low speed" threshold. Moreover, it is not intrinsically necessary for the practice of this invention to have forward counter 22 and reverse counter 23 contain the same number of bits. As was mentioned above, it is the number of different needle selection advances which is required over the entire range of knitting machine operation speeds that determines the minimum bit capacity of reverse counter 23. Depending upon the exactitude with which needle selection advance is to take place, the frequency of clock 16 can be adjusted along with the size and capacity of forward counter 22, reverse counter 23 and read-only memory 24, in order to achieve appropriate results.

We claim:

1. A control system for use in electrically operated rotary knitting machines to provide during each cycle of the machine output pulses at a phase relationship to the machine cycle which depends on rotary speed of the machine, comprising a pulse generator coupled to said machine to generate an input train of pulses at a rate corresponding to the rotary speed of the machine; a clock generator for producing clock pulses at a rate which is much greater than the rate of the input pulses and independent therefrom; a forward counter and a reverse counter each having a plurality of counting stages; a programmable memory having a plurality of address terminals connected to respective stages of said forward counter and a plurality of read-out terminals connected to corresponding stages of said reverse counter; a logic switching circuit connected between said pulse generator, said clock generator and said counters to pass to said forward counter during each cycle of the machine a number of clock pulses which is proportional to the rotary speed of the machine and to generate a control signal when all stages of the forward counter have been set; a logic output stage connected between said switching circuit and said reverse counter to output in response to said control signal said input train of pulses while in the absence of the control signal, outputting via said reverse counter output pulses shifted in time relative to the input pulses by an amount which is determined by the program in said memory.

2. A control system as defined in claim 1, wherein said logic switching circuit includes an AND-gate having a plurality of inputs connected to the stages of said forward counter to produce said control signal when the forward counter is set to its full capacity.

3. A control system as defined in claim 2, wherein said logic switching circuit includes another pulse generator for producing two trains of pulses at a rate corresponding to the input train of pulses but slightly shifted in time relative to each other, one of said two trains of pulses being connected to said logic output stage to be outputted in the presence of said control signal.

4. A control system as defined in claim 3, wherein said additional impulse generator is synchronized with said clock generator.

5. A control system as defined in claim 4, wherein said logic switching circuit further includes two flip-flop stages each having a set input and a reset input and an output, said one train of pulses being connected to the reset input of one of said flip-flop stages and the other train of pulse being connected to the set inputs of both flip-flop stages, the outputs of said flip-flop stages being connected respectively to one input of an assigned AND-gate, the other inputs of the AND-gates being connected to the clock generator, the AND-gate assigned to the first flip-flop stage having its output connected via additional AND-gate to the set input of the forward counter and the output of the other AND-gate being directly connected to the reset input of the reverse counter whereby said control signal being applied to the other input of the additional AND-gate.

6. The control circuit defined by claim 5, wherein the output stage includes a monostable multivibrator which is triggered by the reverse counter.

7. A control system as defined in claim 6, wherein the output stage further includes two AND-gates each having two inputs and an output, an input of one AND-gate being connected to the set input of the reverse counter and to the reset input of the first flip-flop stage and the other input connected to the source of said control signal, one input of the other AND-gate being connected to the output of said monostable multivibrator and the other input of the other AND-gate being connected via an inverter to the source of said control signal, and the outputs of said two AND-gates being connected to the inputs of an OR-gate whereby the output pulses are outputted at the output of said OR-gate.

8. The control circuit defined by claim 1, wherein the clock utilizes a quartz oscillator.

* * * * *